US008480081B2

(12) United States Patent
Inoue

(10) Patent No.: US 8,480,081 B2
(45) Date of Patent: Jul. 9, 2013

(54) SHEET CONVEYING APPARATUS, IMAGE FORMING APPARATUS AND IMAGE READING APPARATUS

(75) Inventor: Hiroshige Inoue, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/609,689

(22) Filed: Sep. 11, 2012

(65) Prior Publication Data

US 2013/0020759 A1 Jan. 24, 2013

Related U.S. Application Data

(62) Division of application No. 13/180,625, filed on Jul. 12, 2011, now Pat. No. 8,292,293.

(30) Foreign Application Priority Data

Jul. 30, 2010 (JP) ..... 2010-171704

(51) Int. Cl.
*B65H 7/02* (2006.01)

(52) U.S. Cl.
USPC ..... 271/227; 271/228

(58) Field of Classification Search
USPC ..... 271/227, 228
See application file for complete search history.

(56) References Cited

U.S. PATENT DOCUMENTS

| | | | |
|---|---|---|---|
| 5,485,991 | A | 1/1996 | Hirano et al. |
| 5,793,399 | A | 8/1998 | Kawakami et al. |
| 5,899,451 | A | 5/1999 | Kiyohara et al. |
| 5,992,993 | A | 11/1999 | Kiyohara et al. |
| 6,045,220 | A | 4/2000 | Kiyohara et al. |
| 6,131,899 | A | 10/2000 | Nojima et al. |
| 6,200,043 | B1 | 3/2001 | Inoue et al. |
| 6,250,827 | B1 | 6/2001 | Nojima et al. |
| 6,654,133 | B2 | 11/2003 | Inoue et al. |
| 7,607,660 | B2 | 10/2009 | Inoue |
| 2008/0006992 | A1 | 1/2008 | Inoue |
| 2010/0189486 | A1 | 7/2010 | Inoue |
| 2011/0215522 | A1 | 9/2011 | deJong et al. |
| 2012/0075681 | A1 | 3/2012 | Inoue |

FOREIGN PATENT DOCUMENTS

| | | | |
|---|---|---|---|
| JP | 4-277151 | A | 10/1992 |
| JP | 2003-146485 | A | 5/2003 |

*Primary Examiner* — David H Bollinger

(74) *Attorney, Agent, or Firm* — Fitzpatrick, Cella, Harper & Scinto

(57) ABSTRACT

The skew feeding amount of a sheet front end is calculated according to the difference between timings when activation sensors detect the sheet front end, and the skew feeding amount of the sheet side edge is calculated according to the difference between side edge positions of the sheet detected by the first side registration detection sensor or the second side registration detection sensor. Further, whether a sheet is a rectangular sheet or a non-rectangular sheet is determined before skew feeding of the sheet is corrected, and, when the sheet is determined to be a rectangular sheet, the skew feeding correcting portion is controlled based on one of the sheet side edge skew feeding amount and sheet front end skew feeding amount and the skew feeding correcting portion is controlled based on the sheet side edge skew feeding amount when the sheet is determined to be a non-rectangular sheet.

8 Claims, 14 Drawing Sheets

SHEET CONVEYING APPARATUS, IMAGE FORMING APPARATUS AND IMAGE READING APPARATUS

This application is a divisional of U.S. patent application Ser. No. 13/180,625, filed Jul. 12, 2011, and allowed Jun. 14, 2012.

BACKGROUND OF THE INVENTION

1. Field of the Invention

The present invention relates to a sheet conveying apparatus, an image forming apparatus and an image reading apparatus and, more particularly, to a configuration of correcting skew feeding of sheets such as recording paper or document to be conveyed to an image forming portion or an image reading portion, and correcting misalignment of sheets in the width direction.

2. Description of the Related Art

Conventionally, image forming apparatuses and image reading apparatuses such as copying machines, printers and facsimiles have sheet conveying apparatuses which convey sheets such as recording paper or document to image forming portions or image reading portions. Further, some sheet conveying apparatuses have a skew feeding correcting portion which corrects skew feeding of sheets to adjust the posture and position of a sheet until it is conveyed to the image forming portion or image reading portion.

Recently, with, for example, an image forming apparatus, various sheets such as coated paper, embossed paper, ultra thick cardboard and ultra thin paper are used. Hence, the image forming apparatus is demanded to not only work more productively, but also increase the speed of correction of skew feeding and more accurately correct skew feeding to support all types of sheets to be used. In view of above, a skew feeding correcting portion is discussed adopting a system in which two pairs of skew feeding correction rollers are disposed at a predetermined interval in the width direction and which corrects skew feeding of a sheet by means of these pairs of skew feeding correction rollers while conveying the sheet without temporarily stopping the sheet in order to increase the speed of correction of skew feeding and more accurately correct skew feeding (Japanese Patent Laid-Open No. 4-277151).

Incidentally, these two pairs of skew feeding correction rollers of the skew feeding correcting portion causes unevenness in rotation (fluctuation of a conveying speed of sheets) due to phase resulting from respective eccentricities and outer peripheral shapes, and, in this case, a sheet is conveyed in a fluctuated manner due to the difference in unevenness in rotation between the skew feeding correction rollers. This fluctuation caused by the difference in unevenness in rotation between the skew feeding rollers cannot be controlled, and therefore there is an issue that, when a sheet reaches a conveying roller in the downstream while skew feeding of the sheet is corrected, the skew feeding amount corresponding to the difference in unevenness in rotation remains. In view of above, a configuration has been conventionally discussed which cancels the difference in unevenness in rotation and corrects skew feeding simultaneously by, for example, rotating conveying rollers with cutouts once and controlling the conveying roller (see U.S. Patent Application Publication No. 2008/006992 A1).

Further, recently, the demand for image formation on various sheets is increasing, and there are cases where images are formed on non-rectangular sheets such as tab sheets which are not necessarily rectangular. A "tab sheet" refers to a sheet having a tab at a side edge in which an index is written for the purpose of classification. However, the position of the tab is not fixed, and is provided by being shifted at several stages to facilitate confirmation of an index written in the tab. There are cases where the conventional skew feeding correcting portion cannot correct skew feeding of these sheets having non-rectangular shapes.

In view of above, as a skew feeding correcting method of correcting skew feeding of sheets having a non-rectangular shape like tab sheets, a method is discussed which corrects skew feeding of sheets by calculating a skew feeding amount based on sheet shape information and skew feeding detection sensor information registered in advance (Japanese Patent Laid-Open No. 2003-146485). More specifically, skew feeding of sheets is corrected by calculating the skew feeding amount based on, for example, information of two skew feeding detection sensors arranged in the width direction and sheet shape information (the dimension of a tab) registered in advance.

Further, another skew feeding correcting method includes detecting a shape of a front end of a sheet by means of a line sensor provided in the width direction to detect skew feeding of the sheet, when the sheet is determined to be a tab sheet, calculating the skew feeding amount of a tab sheet according to image processing and performing skew feeding correction suitable for the tab sheet.

However, with a sheet conveying apparatus which has this conventional skew feeding correcting portion, when, for example, skew feeding of a sheet is corrected according to sheet shape information, if there is a difference between sheet shape information input in advance and the shape dimension of a tab sheet which is actually conveyed, skew feeding occurs. Further, according to a method of detecting a sheet shape by means of a line sensor, particularly when there are rectangular sheets and tab sheets in a mixed manner, if the accuracy to detect skew feeding is improved or the speed of the entire apparatus is increased, image processing required to calculate the skew feeding amount becomes very enormous.

In light of the foregoing, the present invention provides a sheet conveying apparatus, an image forming apparatus and an image reading apparatus which can accurately correct skew feeding of non-rectangular sheets such as tab sheets.

SUMMARY OF THE INVENTION

The present invention is a sheet conveying apparatus including: a front end detecting portion which detects a front end of a sheet; a side edge position detecting portion which detects a position of a side edge parallel to a sheet conveying direction of the sheet; a skew feeding correcting portion which corrects skew feeding of the sheet to be conveyed; and a controlling portion which calculates a skew feeding amount of a sheet front end based on detection of the front end detecting portion, calculate a skew feeding amount of a sheet side edge based on detection of the side edge position detecting portion, wherein the controlling portion determines whether the sheet is a rectangular sheet or a non-rectangular sheet, based on the calculated sheet side edge skew feeding amount and sheet front end skew feeding amount before skew feeding of the sheet is corrected, and controls the skew feeding correcting portion to correct skew feeding of the sheet based on one of the sheet side edge skew feeding amount and the sheet front end skew feeding amount when determining that the sheet is the rectangular sheet and controls the skew feeding correcting portion to correct skew feeding of the sheet based on the sheet side edge skew feeding amount when determining that the sheet is the non-rectangular sheet.

According to the present invention, by determining whether a sheet is a rectangular sheet or non-rectangular sheet before skew feeding of the sheet is corrected and controlling a skew feeding correcting portion based on the skew feeding amount of the sheet side edge when the sheet is determined to be a non-rectangular sheet, it is possible to accurately correct skew feeding of the non-rectangular sheet.

Further features of the present invention will become apparent from the following description of exemplary embodiments with reference to the attached drawings.

DESCRIPTION OF THE EMBODIMENTS

Figure 1:
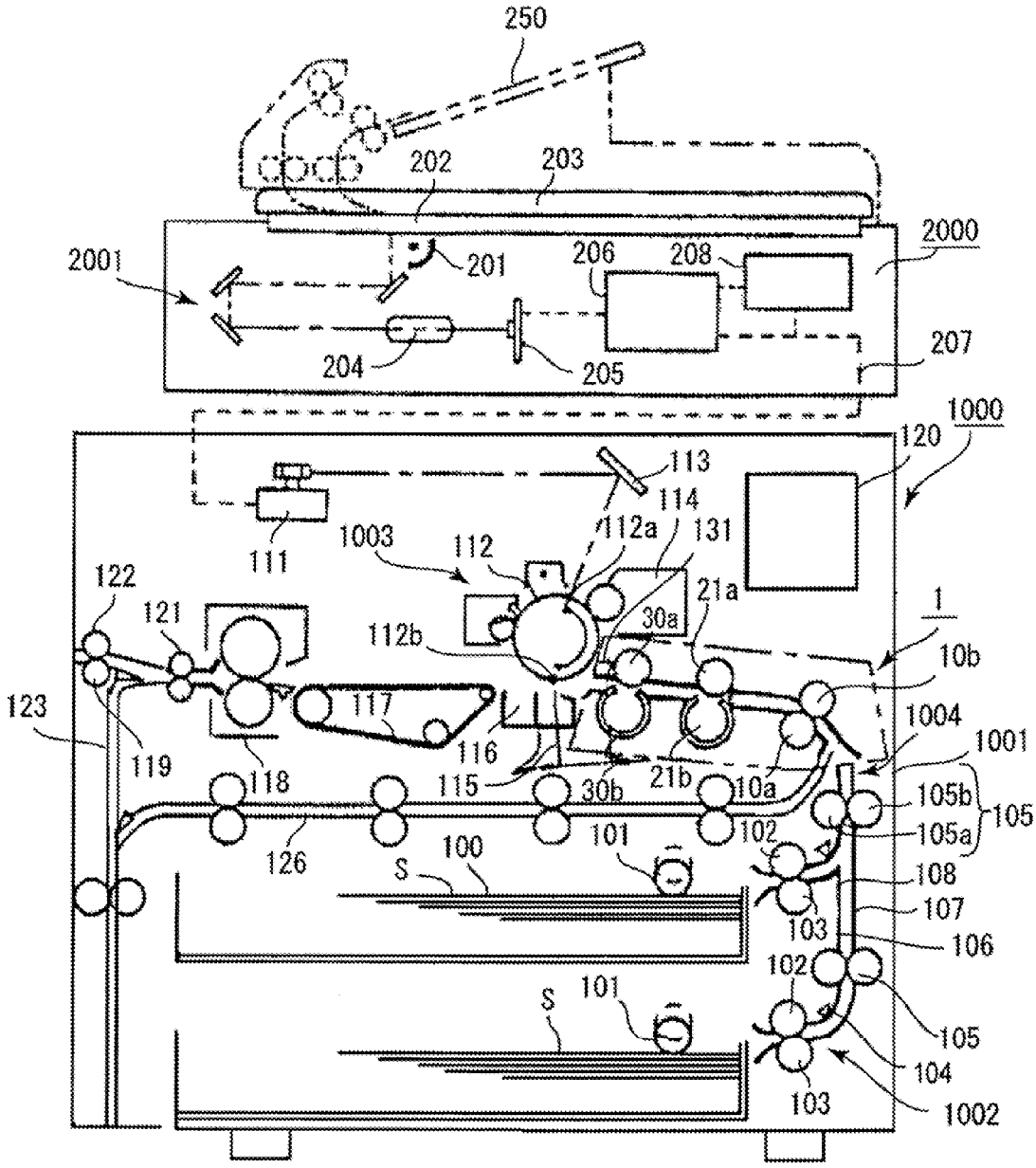
FIG. 1 is a schematic configuration diagram of a printer which is an example of an image forming apparatus according to a first embodiment of the present invention.

Hereinafter, an embodiment of the present invention will be described in detail with reference to drawings. FIG. 1 is a schematic configuration diagram of a printer which is an example of an image forming apparatus according to an embodiment of the present invention.

In FIG. 1, a printer 1000 has a printer body 1001, and a scanner 2000 which is arranged on the upper surface of the printer body 1001.

The scanner 2000 which reads document has a scan optical system light source 201, a platen glass 202 and a document platen 203 which is opened and closed. Further, the scanner 2000 has, for example, an image reading portion 2001 which has a lens 204, a light receiving element (photoelectric converting element) 205, an image processing portion 206 and a memory 208 which stores image processing signals processed in the image processing portion 206.

Furthermore, in order to read document, the scanner irradiates document (not illustrated) which is placed on the platen glass 202, with light using the scan optical system light source 201. Still further, the read document image is processed in the image processing portion 206, then is converted into an electrically encoded electrical signal 207 and is transmitted to a laser scanner 111 which is an image creating unit. In addition, the image information processed and encoded in the image processing portion 206 may be temporarily stored in the memory 208, and transmitted to the laser scanner 111 where necessary according to a signal from a controller 120.

The printer body 1001 has a sheet feeding apparatus 1002, a sheet conveying apparatus 1004 which conveys a sheet S fed by the sheet feeding apparatus 1002, to the image forming portion 1003, and a controller 120 which is a controlling unit for controlling the printer 1000. Further, on one side of the printer body 1001, a sheet processing apparatus 500 is provided which processes the sheet S discharged from the printer body 1001.

The sheet feeding apparatus 1002 has a separating portion which has two (a plurality of) sheet cassettes 100, a pick-up roller 101, a feed roller 102 and a retard roller 103. Further, the sheets S in the sheet cassettes 100 are separated and fed at a predetermined timing one by one by the functions of the pick-up roller 101 which is lifted and lowered and rotates, and the separating portion.

The sheet conveying apparatus 1004 has a pair of vertical path rollers 105 (105*a* and 105*b*), a pair of assist rollers 10 (10*a* and 10*b*), and a skew feeding/registration correcting portion 1 (described below) which has a skew feeding correcting portion 1A and a registration correcting portion 1B. Further, the sheet S fed from the sheet feeding apparatus 1002 passes a sheet conveying path 108 which has guide plates 106 and 107 having curved upper parts, and then is led to the skew feeding/registration correcting portion 1. Subsequently, although described below, this skew feeding/registration correcting portion 1 corrects skew feeding and misalignment of the sheet S in the width direction orthogonal to the sheet conveying direction, and then the sheet S is conveyed to the image forming portion 1003.

The image forming portion 1003 adopts an electrophotographic system, and has, for example, a photosensitive drum 112 which is an image bearing member, a laser scanner 111 which is an image writing unit, a development device 114, a transfer charger 115 and a separating charger 116. Further, when an image is formed, laser light from the laser scanner 111 is first reflected by a mirror 113 and is irradiated on an exposure position 112*a* on the photosensitive drum which rotates in a clockwise direction, so that a latent image is formed on the photosensitive drum. Furthermore, the latent image formed on the photosensitive drum in this way is visualized as a toner image by the development device 114.

In addition, in FIG. 1, a registration sensor 131 is provided in the downstream of the registration correcting portion 1B, and detects the sheet S which has passed the registration correcting portion 1B. In addition, when the registration sensor 131 detects the sheet S which has passed the registration correcting portion 1B, the controller 120 outputs a sheet front end signal (image front end signal) to the laser scanner 111 based on this detection signal after, for example, T seconds as described below. By this means, the laser scanner 111 starts irradiation of laser light.

Next, the toner image on the photosensitive drum which is visualized in this way is then transferred onto the sheet S by the transfer charger 115 in the transfer portion 112*b*. In addition, the distance from the laser light irradiation position 112*a* of the photosensitive drum 112 to the transfer portion 112*b* is 10.

Further, the sheet S onto which the toner image is transferred in this way is electrostatically separated from the photosensitive drum 112 by the separating charger 116 is conveyed to a fixing apparatus 118 by a conveying belt 117, and a transferred image is eternally fixed in the fixing apparatus 118. Subsequently, the sheet S on which an image is fixed is discharged to and stacked in a sheet stack tray (not illustrated) by conveying rollers 119 and 121 and discharge roller 122. In addition, when images are formed on both sheet faces, the sheet on one face of which an image is formed passes a reverse path 123 and duplex path 126 and is again conveyed to the image forming portion 1003, and an image is formed on the back face of the sheet S on which an image is not formed.

Figure 2:
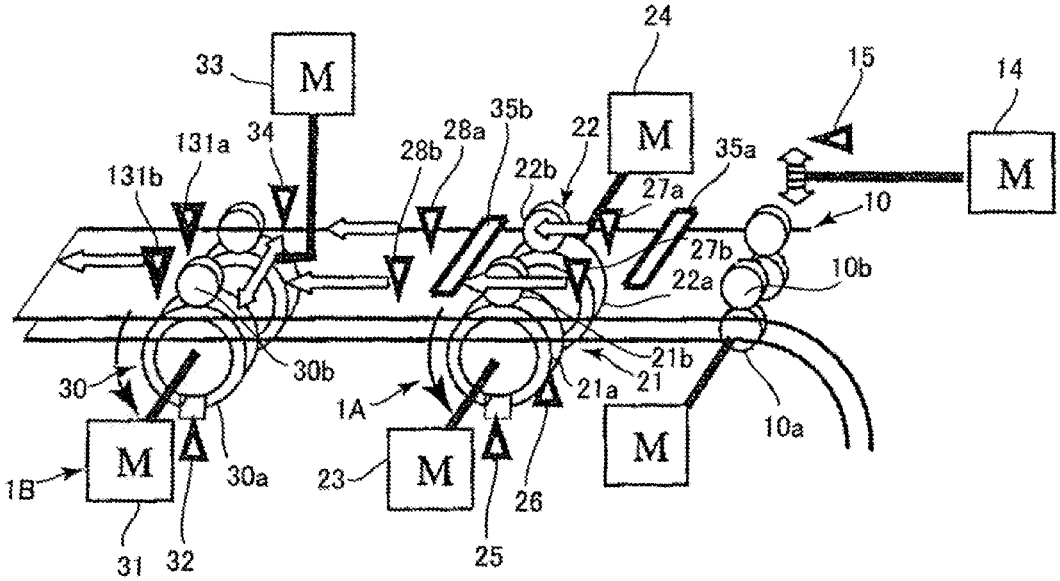
FIG. 2 is a view describing a configuration of a skew feeding/registration correcting portion provided in the sheet conveying apparatus of the above printer.

Next, the skew feeding/registration correcting portion 1 will be described. As illustrated in FIG. 2, the skew feeding/registration correcting portion 1 has a pair of pre-registration rollers 10, the skew feeding correcting portion 1A which corrects skew feeding of sheets and the registration correcting portion 1B which corrects misalignment of a sheet in the width direction. A pair of pre-registration rollers 10 have a pre-registration driving roller 10*a* and a pre-registration driven roller 10*b* which presses the pre-registration driving roller 10*a* by means of a pressure spring (not illustrated). In addition, the pre-registration driving roller 10*a* is driven in the sheet conveying direction by the pre-registration motor 11. Further, pressing of the pre-registration driven roller 10*b* against the pre-registration driving roller 10*a* is released by the pre-registration release motor 14. The phase of this pre-registration release motor 14, in other words, contact and separation of a pair of pre-registration rollers 10, is detected by the pre-registration release HP sensor 15.

The skew feeding correcting portion 1A has two pairs of skew feeding correction rollers 21 and 22 disposed at a predetermined interval in the width direction. Pairs of skew feeding correction rollers 21 and 22 respectively have driving rollers 21*a* and 22*a* which are driving rotating members having cutouts on peripheral surfaces, and driven rollers 21*b* and 22*b* which are follower rotating members for pressing the driving rollers 21*a* and 22*a* by means of pressure springs (not illustrated). In addition, the driving rollers 21*a* and 22*a* are disposed at a predetermined interval in the width direction orthogonal to the sheet conveying direction, and are connected with skew feeding correction motors 23 and 24 such that the driving rollers 21*a* and 22*a* are driven independently. In addition, in FIG. 2, skew feeding correction HP sensors 25 and 26 detect HPs (home positions) of the driving rollers 21*a* and 22*a*.

Further, in the upstream of pairs of skew feeding correction rollers 21 and 22 in the sheet conveying direction, activation sensors 27*a* and 27*b* which are front end detecting portions for detecting the front end of a sheet and detecting skew feeding of the sheet front end are disposed at a predetermined interval in the width direction. Furthermore, by calculating the skew feeding amount according to timings when the activation sensors 27*a* and 27*b* detect the sheet front end and starting driving the skew feeding correction motors 23 and 24, it is possible to correct skew feeding of the sheet.

In the upstream of pairs of skew feeding correction rollers 21 and 22 in the sheet conveying direction, a first side registration detection sensor 35*a* is provided which is a side edge position detecting portion for continuously detecting the position of a sheet side edge parallel to the sheet conveying direction of a sheet to be conveyed and detecting the position misalignment amount of the sheet side edge in the width direction. In addition, with the present embodiment, the first side registration detection sensor 35*a* has a line sensor, and, as described below, detects the change of a side registration position which is the position of the sheet side edge in the width direction and calculates the skew feeding amount of the sheet in the conveying direction.

Further, in the downstream of pairs of skew feeding correction rollers 21 and 22 in the sheet conveying direction, skew feeding detection sensors 28*a* and 28*b* which detect whether skew feeding is completely corrected by pairs of skew feeding correction rollers 21 and 22 are disposed at a predetermined interval in the width direction. Furthermore, when these skew feeding detection sensors 28*a* and 28*b* detect skew feeding of the sheet front end, pairs of skew feeding correction rollers 21 and 22 correct skew feeding again. Still further, in the downstream of pairs of skew feeding correction rollers 21 and 22 in the sheet conveying direction, a second side registration sensor 35*b* is provided which is a line sensor of a side edge position detecting portion for detecting the side registration position and calculating the skew feeding amount in the sheet conveying direction.

In addition, the center line connecting the activation sensors 27*a* and 27*b* and skew feeding detection sensors 28*a* and 28*b* is arranged parallel to the axial line of the photosensitive drum 112 provided on the downstream side in the conveying direction. With the present embodiment, skew feeding of a sheet is corrected by preceding side deceleration control for decelerating the preceding side of the sheet front end. Further, although two (a plurality of) activation sensors 27 and two (a plurality of) skew feeding detection sensors 28 are provided with the present embodiment, the number of activation sensors 27 and skew feeding detection sensors 28 may be increased where necessary to enable reliable detection of a tab part of a sheet (described below).

The registration correcting portion 1B has two pairs of registration rollers 30 which have a registration driving roller 30*a* which is a driving rotating member having a cutout on the peripheral surface, and a registration driven roller 30*b* which is a follower rotating member for pressing the registration driving roller 30*a* by means of a pressure spring (not illustrated). Further, this registration driving roller 30*a* is connected to the registration motor 31. Furthermore, the registration driving rollers 30 are provided slidably in the axial direction, and are slid in the width direction by the registration shift motor 33.

Still further, pairs of registration rollers 30 slide in the axial direction when the registration shift motor 33 is driven according to the side registration position (side edge position) detected by the second side registration detection sensor 35*b*, so that the side edge position of the sheet is corrected. That is, with the present embodiment, pairs of registration rollers 30 which are the side edge correcting portion move the sheet in the width direction while conveying the sheet according to the side edge position detected by the second side registration detection sensor 35*b*, and correct the side edge position of the sheet.

Further, in the downstream of a pair of registration rollers 30, registration sensors 131*a* and 131*b* which detect the front end of a sheet are arranged at a predetermined interval. In addition, a registration HP sensor 32 detects a HP (home position) of the registration driving roller 30*a*, and a registration shift HP sensor 34 detects HPs (home positions) of pairs of registration rollers 30 in the width direction.

Figure 3:
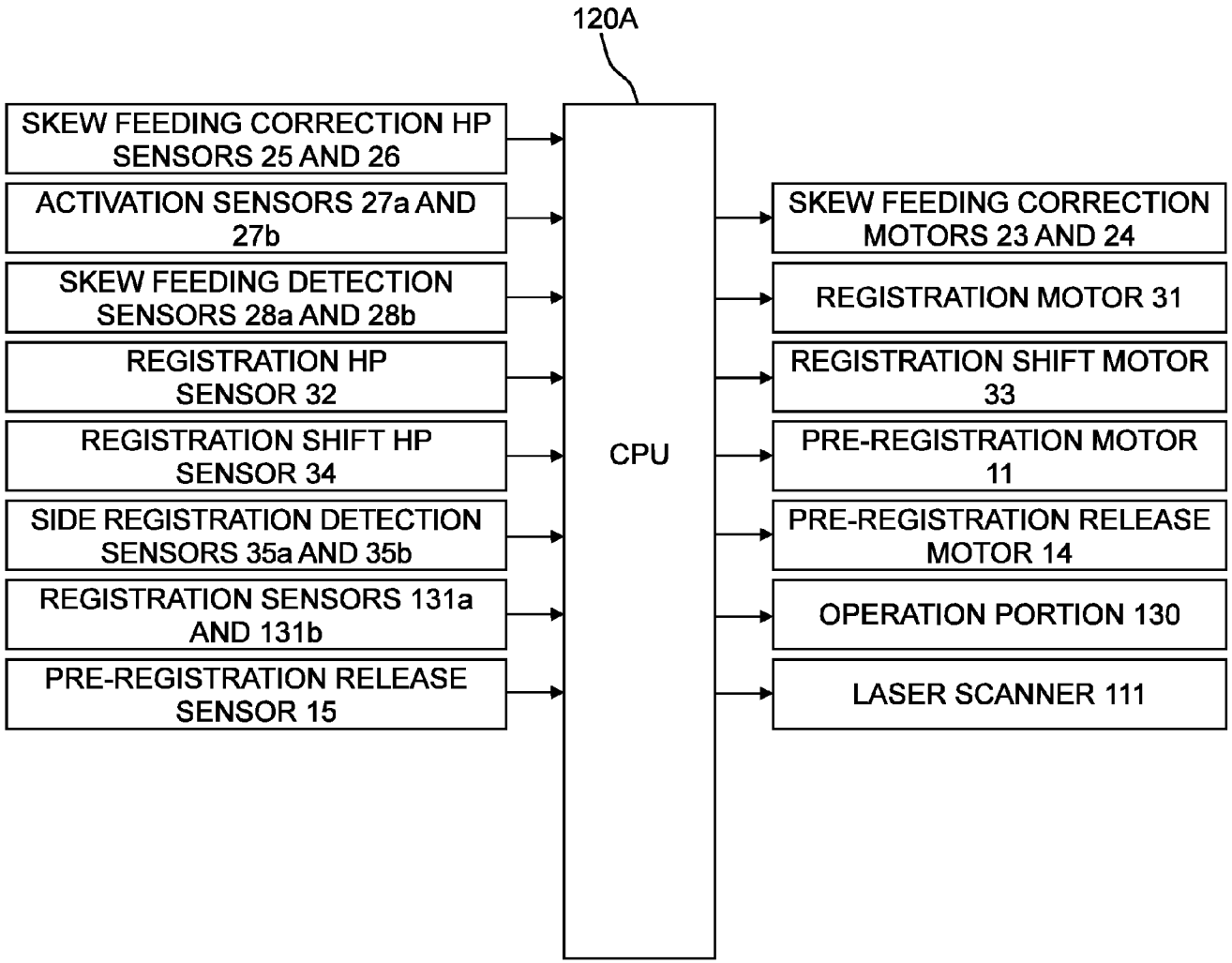
FIG. 3 is a control block diagram of the above printer.

FIG. 3 is a control block diagram of the printer 1000, and a CPU 120A provided in the controller 120 (see FIG. 1) receives inputs of detection signals from the above skew feeding correction HP sensors 25 and 26 and the above activation sensors 27*a* and 27*b*. Further, this CPU 120A which is the controlling portion receives inputs of detection signals from the skew feeding detection sensors 28*a* and 28*b*, registration HP sensor 32, registration shift HP sensor 34, side registration detection sensors 35*a* and 35*b*, registration sensors 131*a* and 131*b* and pre-registration release HP sensor 15.

By contrast with this, the CPU 120A is connected with the pre-registration motor 11, pre-registration release motor 14, skew feeding correction motors 23 and 24, registration motor 31, registration shift motor 33, laser scanner 111 and operation portion 130. Further, the CPU 120A drives each motor based on a detection signal from each sensor and a copy or print start signal from the operation portion 130.

The CPU 120A controls driving of the skew feeding correcting portion 1A to detect the skew feeding amount of the sheet front end and correct skew feeding of the sheet, and controls the registration correcting portion 1B to detect the position misalignment amount of the sheet side edge and correct the position of the sheet for which skew feeding is corrected and which is misaligned in the width direction. Further, as described below, the CPU 120A compares the skew feeding amount of the sheet front end detected by the activation sensors 27*a* and 27*b* and the skew feeding amount of the sheet side edge detected by the first side registration detection sensor 35*a*, and, when the two skew feeding amounts are different, determines that the sheet has a tab. When, for example, a sheet having a tab (hereinafter "tab sheet") is skew fed, the time when the activation sensor on the side of the sheet having no tab detects the sheet front end and the time when the activation sensor on the side of the sheet having the tab detects the sheet front end comes earlier because of the tab compared to a normal sheet.

Figure 6:
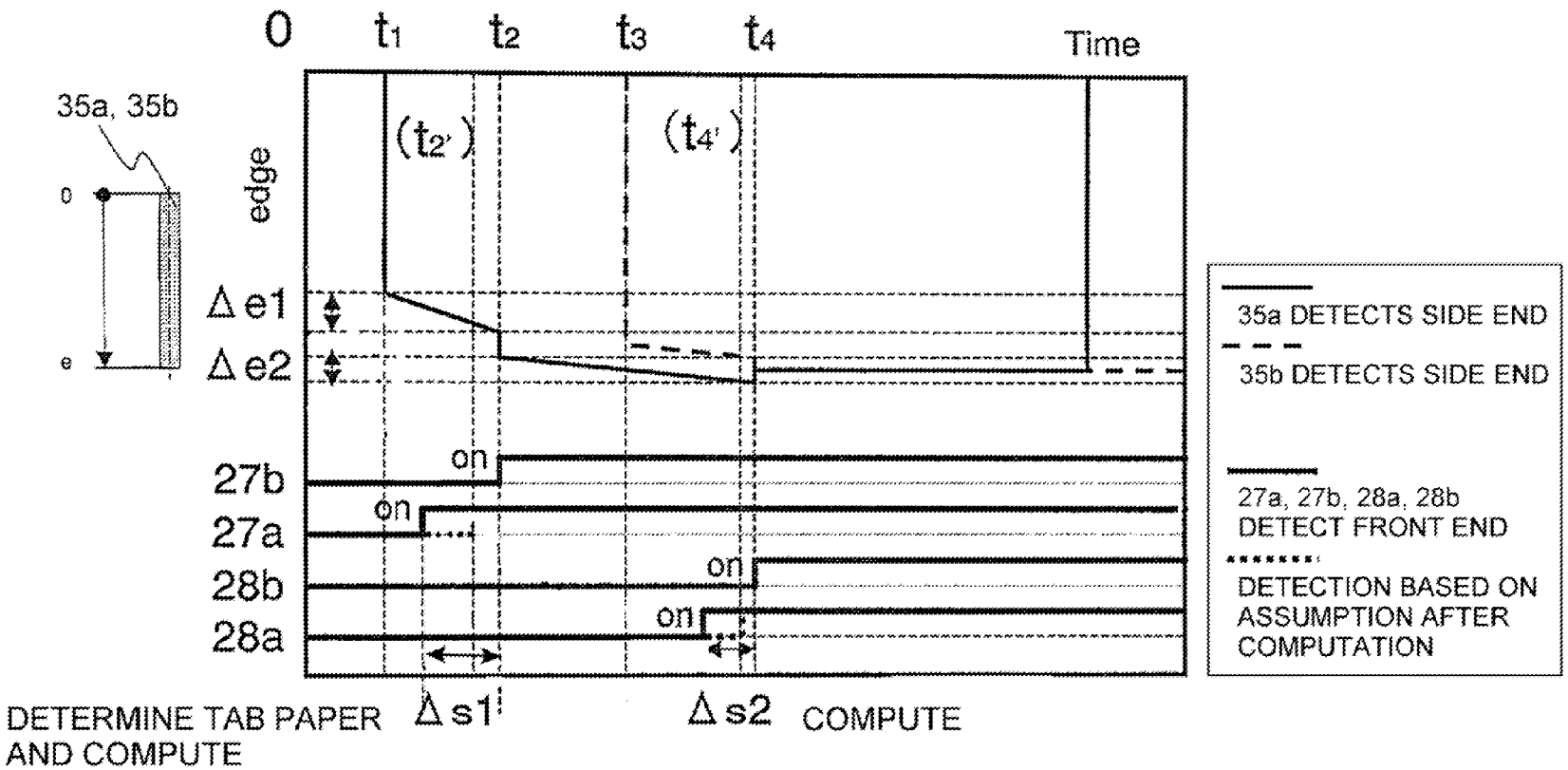
FIG. 6 is an explanatory view for parameters for calculating a skew feeding adjustment amount in the above skew feeding correcting portion.
Figure 8A:
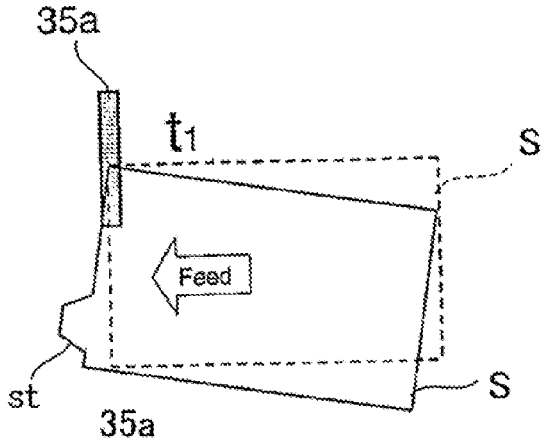
FIGS. 8A to 8D are third views describing a skew feeding correcting and registration correcting control operation of the above skew feeding correcting portion.
Figure 8B:
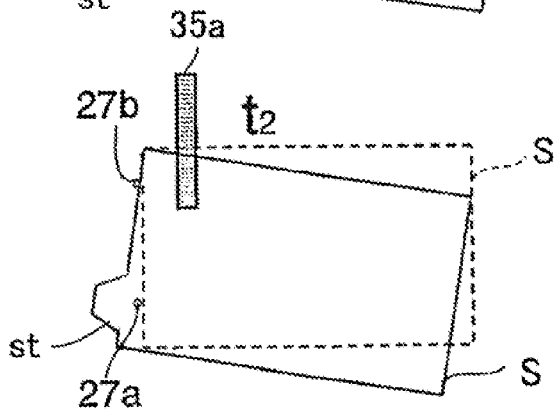

Further, with the present embodiment, as illustrated in FIG. 8B (described below), when the sheet which is skew fed is determined to be a tab sheet, the side edge skew feeding amount detected by the first side registration detection sensor 35*a* is corrected by Δe1 corresponding to the tab as illustrated in FIG. 6 (described below). Furthermore, based on this corrected side edge skew feeding amount, the skew feeding correction motors 23 and 24 are activated to start a skew feeding correction operation. That is, when the sheet which is skew fed is determined to be a tab sheet, a skew feeding correction operation is started based on the detection timing of the first side registration detection sensor 35*a*. In addition, with the present embodiment, the first skew feeding correction operation is performed based on the detection timing of the first side registration detection sensor 35*a*, and then the second skew feeding correction operation is performed based on the detection timing of the second side registration detection sensor 35*b* to accurately correct skew feeding.

Figure 4A:
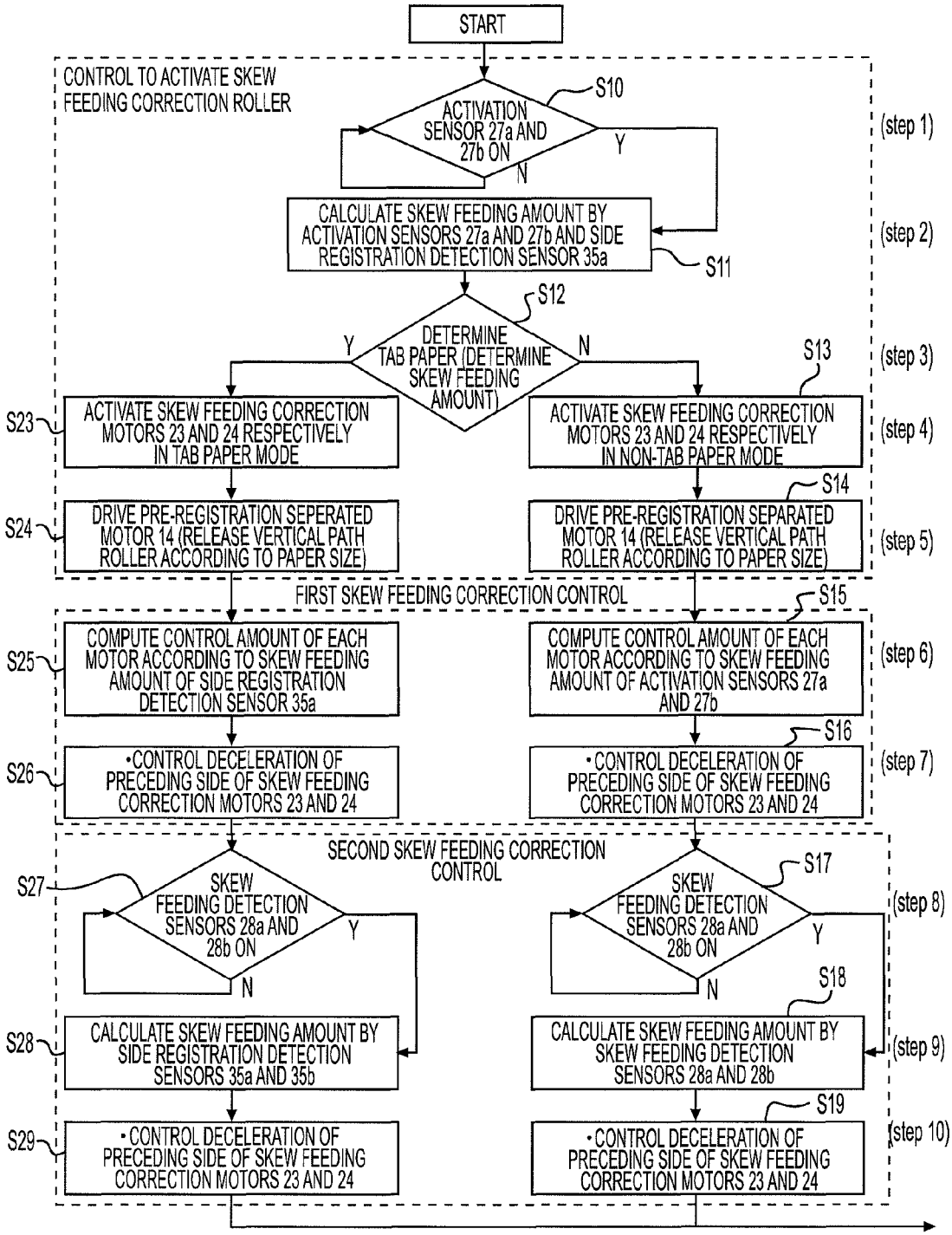
FIGS. 4A and 4B are a flowchart describing a skew feeding correcting and registration correcting control operation of the above skew feeding correcting portion.
Figure 4B:
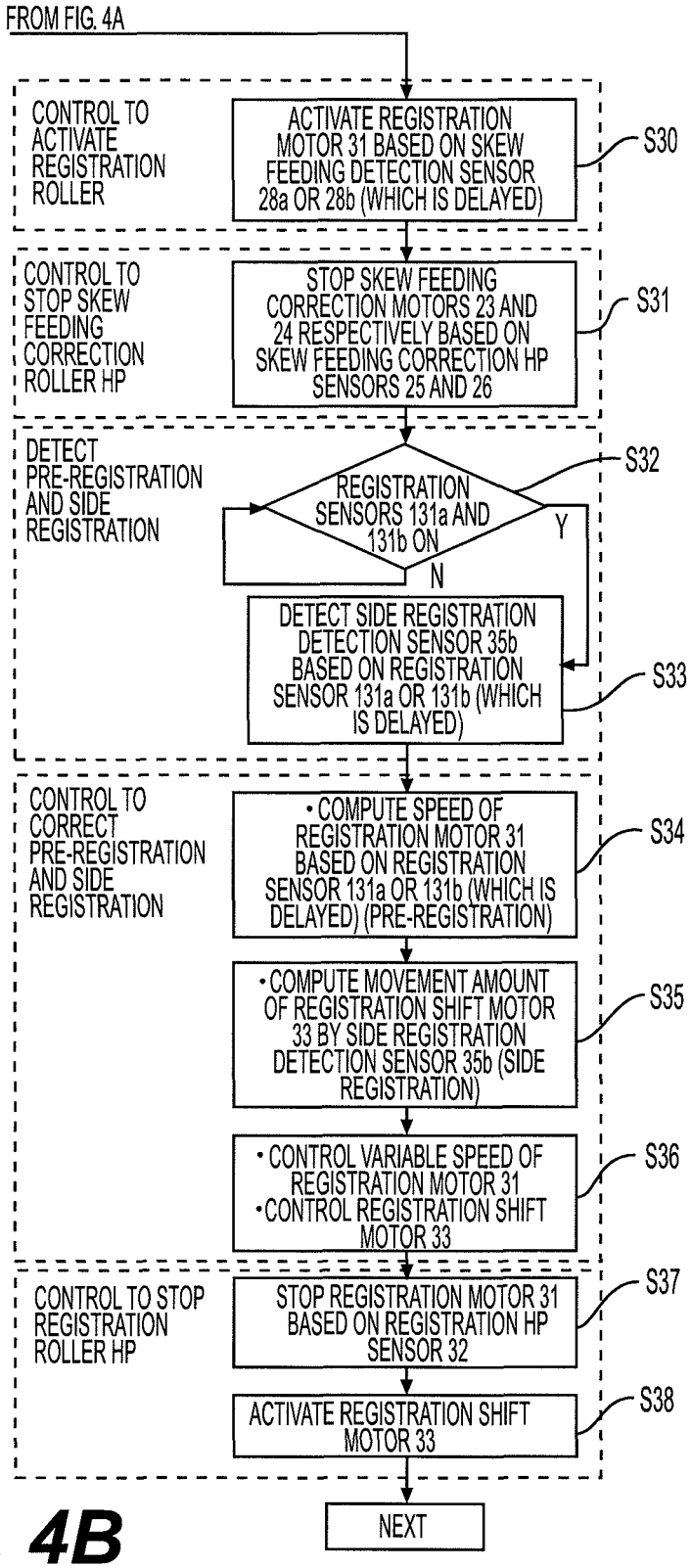

Next, skew feeding correction and registration control operation by this CPU 120A (controller 120) will be described with reference to FIG. 4. In addition, with the present embodiment, tab sheets of non-rectangular sheets are among non-tab sheets of rectangular sheets in a mixed manner and conveyed.

Figure 5A:
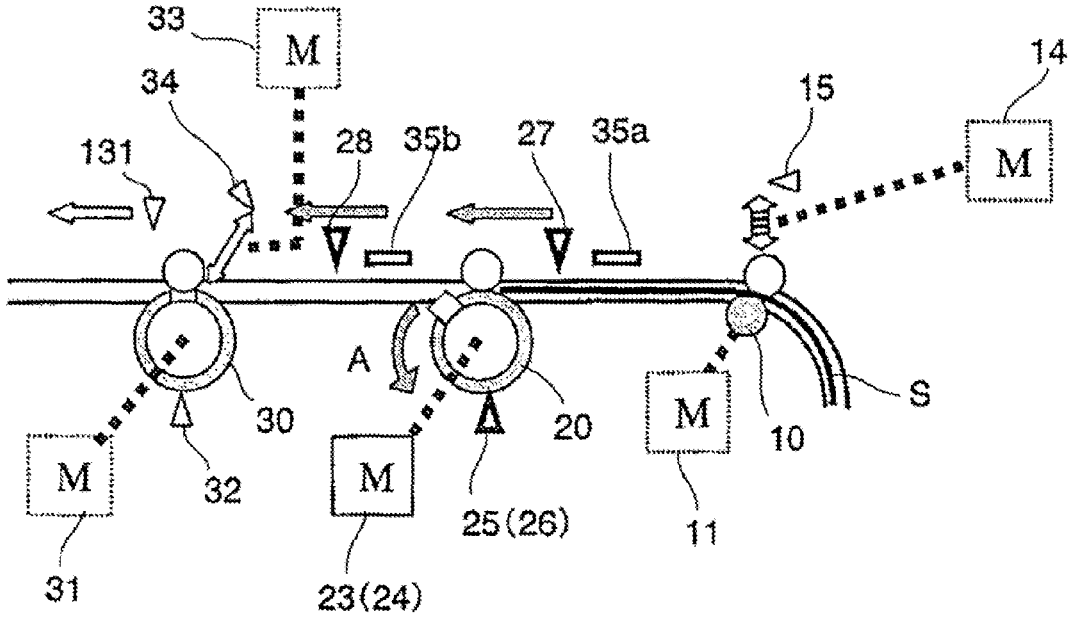
FIG. 5A is a first view (lateral surface) describing a skew feeding correcting and registration correcting control operation of the above skew feeding correcting portion.

When a copy or print signal is input from the operation portion 130, the sheet cassette 100 is selected, and a non-tab sheet or tab sheet is fed from the selected sheet cassette 100, is passed through a pair of pre-registration rollers 10 by a pair of conveying rollers 105 and reaches the skew feeding/registration correcting portion 1. Next, the side edge of the sheet S conveyed to the skew feeding/registration correcting portion 1 as illustrated in FIG. 5A is detected by the first side registration detection sensor 35*a*. Subsequently, when the activation sensors 27*a* and 27*b* detect (ON) the sheet S (Y in S10), the activation sensors 27*a* and 27*b* and first side registration detection sensor 35*a* then detect whether the sheet is skew fed.

Figure 5B:
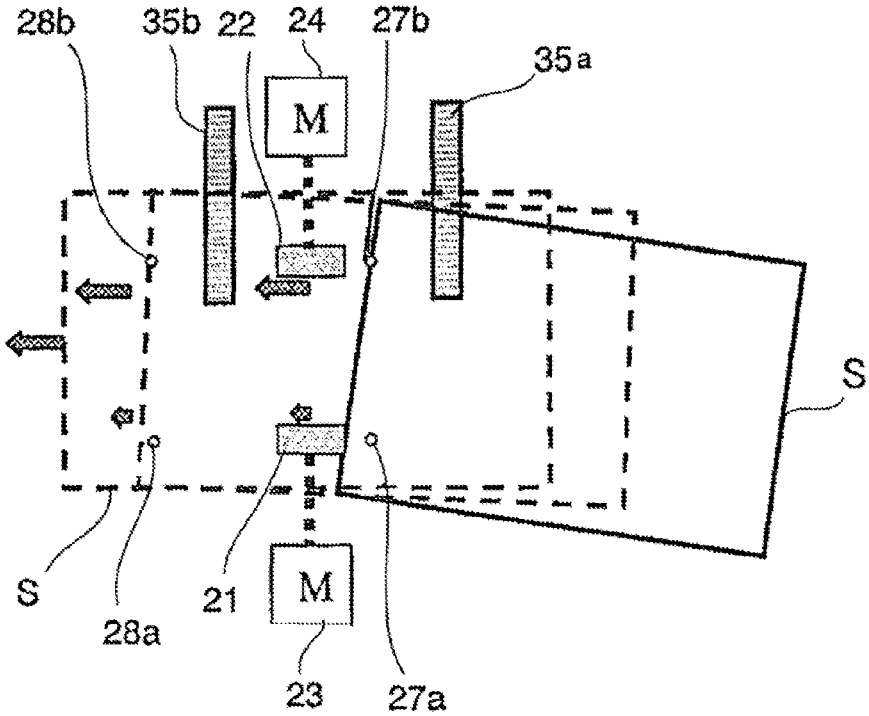
FIG. 5B is a first view (plan view) describing a skew feeding correcting and registration correcting control operation of the above skew feeding correcting portion.

When the sheet S is skew fed as illustrated in FIG. 5B, a front end skew feeding amount Δs1 is calculated which is the skew feeding amount of the sheet front end due to the difference between the timings when the activation sensors 27*a* and 27*b* illustrated in FIG. 6 detect the sheet. Further, according to the difference between the sheet side edge detection positions detected by the first side registration detection sensor 35*a* at the times t1 and t2, that is, the difference between misalignment amounts of the sheet side edge position, the side edge skew feeding amount Δe1 which is the skew feeding amount of the sheet side edge is calculated. That is, when the activation sensors 27*a* and 27*b* detect (ON) the sheet S, the activation sensors 27*a* and 27*b* and first side registration detection sensor 35*a* calculate the skew feeding amount (S11).

Next, the front end skew feeding amount Δs1 and the side edge skew feeding amount Δe1 are compared to determine whether the sheet is a tab sheet (tab paper) (S12). Meanwhile, in case of a non-tab sheet, the front end skew feeding amount Δs1 and side edge skew feeding amount Δe1 are the same, and therefore, if the front end skew feeding amount Δs1 and side edge skew feeding amount Δe1 are the same, the sheet S is determined to be a non-tab sheet (N in S12), and skew feeding of the sheet is corrected in the non-tab paper mode. That is, when the sheet is not a tab sheet, the skew feeding correction motors 23 and 24 are subsequently activated respectively (S13) to start a skew feeding correction operation. Further, the pre-registration release motor 14 is driven according to the size of the sheet (paper size) in this case (S14) to release nipping by the pre-registration roller 10 and release nipping by a pair of conveying rollers 105.

After performing control to activate the skew feeding correction roller in this way, the control amount of each motor of the skew feeding correction motors 23 and 24 (correction time T1 and decelerated speed ΔV1) for correcting skew feeding is computed according to the skew feeding amount Δs1 calculated based on the detection timings of the activation sensors 27*a* and 27*b* (S15). Further, the skew feeding correction motors 23 ad 24 are driven based on the computed control amount to perform the above preceding side deceleration control (S16). By this means, pairs of skew feeding correction rollers 21 and 22 with roller nip portions released rotate to perform first skew feeding correction. In this case, the roller phases of the driving rollers 21*a* and 22*a* of pairs of skew feeding correction rollers 21 and 22 are in-phase. Consequently, it is possible to cancel the difference due to unevenness in rotation of pairs of skew feeding correction rollers 21 and 22, and correct skew feeding simultaneously.

Next, after this first skew feeding correction control processing, processing stands by until the skew feeding detection sensors 28*a* and 28*b* are turned on (S17). Further, when the skew feeding detection sensors 28*a* and 28*b* are turned on (Y in S17), the skew feeding amount of the sheet front end is calculated based on the respective detection timings to calculate the front end skew feeding amount ΔS2 (S18). Subsequently, the control amount of each motor is computed based on the calculated skew feeding amount and the skew feeding correction motors 23 and 24 are driven based on the computed control amount to perform the above preceding side deceleration control (S19). By this means, pairs of skew feeding correction rollers 21 and 22 rotate, so that skew feeding of the sheet S is completely corrected.

Figure 7A:
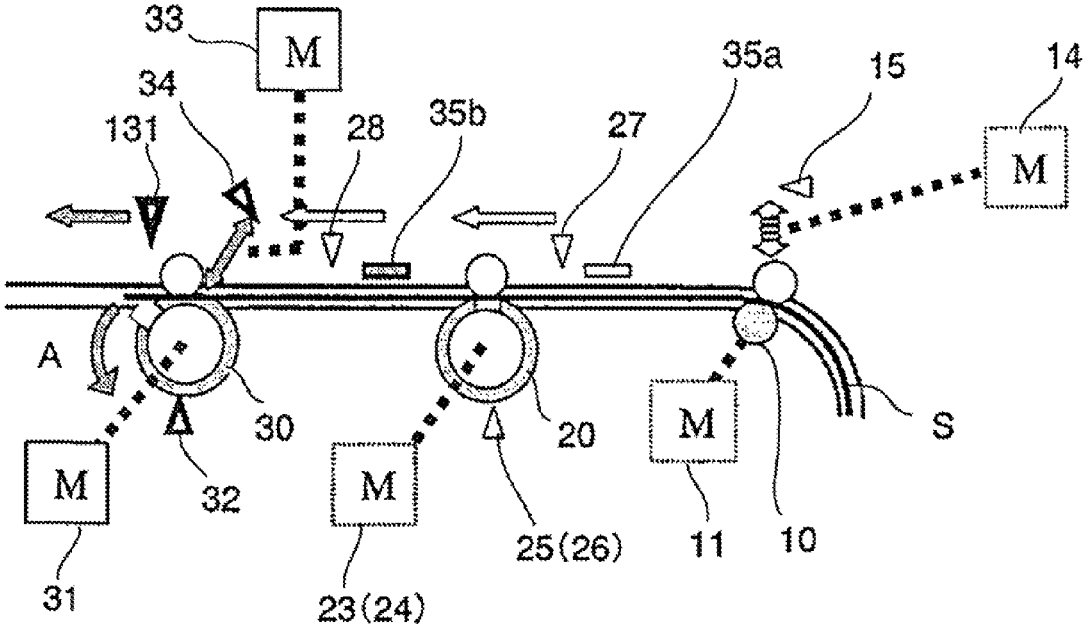
FIG. 7A is a second view (lateral surface) describing a skew feeding correcting and registration correcting control operation of the above skew feeding correcting portion.
Figure 7B:
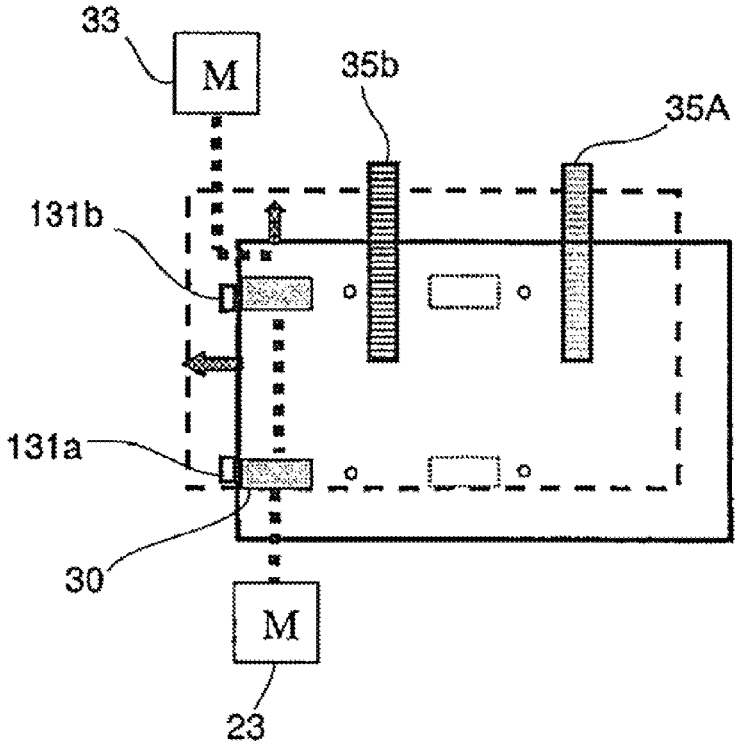
FIG. 7B is a second view (plan view) describing a skew feeding correcting and registration correcting control operation of the above skew feeding correcting portion.

Next, after performing second skew feeding correction control processing in this way, the sheet S having the skew feeding state corrected by pairs of skew feeding correction rollers 21 and 22 is conveyed to a pair of registration rollers 30. Subsequently, the registration motor 31 is activated based on the detection time of the skew feeding detection sensor 28*a* or 28*b* which is delayed (S30). Further, by performing control to activate the registration roller in this way, as illustrated in FIGS. 7A and 7B, pairs of registration rollers 30 having roller nip portions released rotate to convey the sheet S. Subsequently, when the sheet S is nipped by a pair of registration rollers 30, the skew feeding correction motors 23 and 23 are respectively stopped in a state where the roller nip portions of pairs of skew feeding correction rollers 21 and 22 are released based on the skew feeding correction HP sensor (S31).

Next, after performing control to stop the skew feeding correction roller HP in this way, processing stands by until the registration sensors 131*a* and 131*b* detect the sheet and are turned on (S32). Further, when the registration sensors 131*a* and 131*b* detect the front end of the sheet S (Y in S32), the second side registration sensor 35*b* detects the side edge position of the sheet S based on the detection time of the registration sensor 131*a* or 131*b* which is delayed (S33). Next, after performing processing of detecting the pre-registration and side registration in this way, the speed of the registration motor 31 is computed based on the time difference Δt3 between the detection timing of the registration sensor 131*a* or 131*b* which is delayed and the timing (ITOP) when the photosensitive drum is irradiated with laser light (S34).

That is, the deceleration speed and variable speed time of the registration motor 31 are calculated for synchronizing the front end of an image conveyed over the distance 10 from the laser light irradiation position 112*a* of the photosensitive drum 112 to the transfer portion 112*b* and the front end of the sheet conveyed over a distance 11 from the registration sensor 131 to the transfer portion 112*b*. Further, the movement amount of the registration shift motor 33 is computed to synchronize the image side registration position on the photosensitive drum 112 and the side registration position of the sheet S based on the detection signal of the second side registration sensor 35*b* (S35). That is, the speed in the shift direction and variable speed time of the registration shift motor 33 are calculated.

Next, the variable speed of the registration motor 31 is controlled and the registration shift motor 33 is controlled based on the deceleration speed and variable speed time of the registration motor 31 calculated in this way (S36). Further, by controlling the registration motor 31 and registration shift motor 33 in this way, pairs of registration motors 31 are shifted, so that it is possible to align the image position on the photosensitive drum 112, and the front end position of the sheet S and side registration position.

Next, after performing control processing of correcting the pre-registration and side registration in this way, when the shift operation of the sheet S is finished, the sheet S conveyed by pairs of registration rollers 30 is transferred onto and attracted by the photosensitive drum 112. Subsequently, the registration motor 31 is stopped in a state where the roller nip portions of pairs of the registration motors 30 are released based on the registration HP sensor 26 (S37). At the same time, the registration shift motor 33 is activated (S38), pairs of registration rollers 30 are shifted and moved in a direction opposite to S26 and, when the registration shift HP sensor 34 detects this movement, the registration shift motor 33 stops.

By contrast with this, when the sheet is a tab sheet, the first side registration detection sensor 35*a* detects the sheet side edge as illustrated in FIG. 8A, and the activation sensors 27*a* and 27*b* detect the sheet front end as illustrated in FIG. 8B. Further, the front end skew feeding amount Δs1 and side edge skew feeding amount Δe1 are calculated according to the signals from the activation sensors 27*a* and 27*b* and first side registration detection sensor 35*a*.

When the sheet is a tab sheet, the front end skew feeding amount Δs1 and side edge skew feeding amount Δe1 illustrated in FIG. 6 are not the same, and therefore, when the front end skew feeding amount Δs1 and side edge skew feeding amount Δe1 are different, the sheet S is determined to be a tab sheet (N in S12) and skew feeding of the sheet is corrected in the tab paper mode. That is, when the sheet is a tab sheet, the skew feeding correction motors 23 and 24 are subsequently activated respectively (S23) to start a correcting skew feeding operation. Further, the pre-registration release motor 14 is driven according to the sheet size (paper size) in this case (S24) to release nipping by the pre-registration roller 10 and release nipping by a pair of conveying rollers 105.

Next, after performing control to activate the skew feeding correction roller in this way, the control amount of each motor of the skew feeding correction motors 23 and 24 (correction time T1 and deceleration speed ΔV1) for correcting skew feeding is computed according to the side edge skew feeding amount Del calculated according to the signal from the side registration detection sensor 35*a* (S25). When, for example, the sheet on the activation sensor 27*a* side precedes as illustrated in FIGS. 8A to 8D, a pair of skew feeding correction rollers 21 (skew feeding correction motor 23) is decelerated to correct skew feeding. Further, with the present embodiment, the correction time T1 and deceleration speed ΔV1 of control parameters are calculated according to the side edge skew feeding amount Δe1 to satisfy the following equation.

$$V_0 \times \Delta t_1 = \int_{T_1} \Delta V_1 \, dt$$

Subsequently, the skew feeding correction motors 23 and 24 are driven based on the computed control amount to perform the above preceding side deceleration control (S26). That is, the skew feeding correction motor 23 decelerates the sheet conveying speed from V0 to ΔV1 in the first skew feeding correction section (T1), and accelerates the sheet conveying speed to V0 when the skew feeding correction section ends. By this means, pairs of skew feeding correction rollers 21 and 22 with the roller nip portions released rotate to perform first skew feeding correction. In addition, a pair of skew feeding correction rollers 21 (skew feeding correction motor 23) having a tab St of the tab sheet S in this case is activated based on a detection time t2' of the activation sensor 27*a* (time corrected by the side edge skew feeding amount Δe1 based on t2). Further, when first skew feeding correction is finished, the roller phases of the driving rollers 21*a* and 22*a* of pairs of skew feeding correction rollers 21 and 22 are in-phase.

Figure 8C:
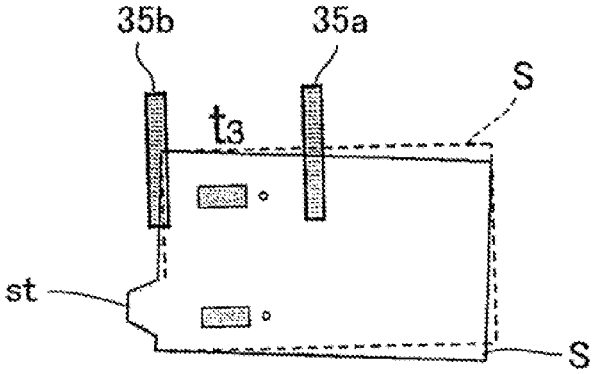
Figure 8D:
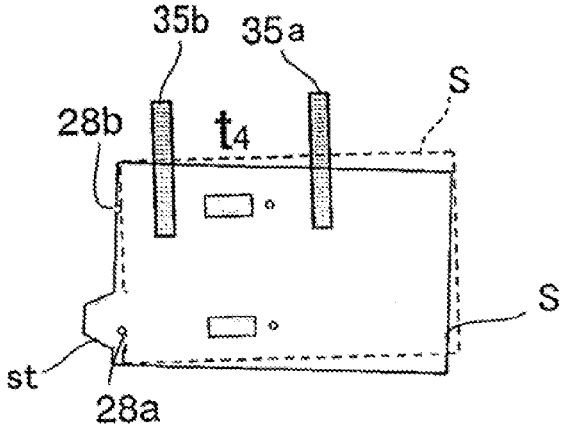

Next, after performing first skew feeding correction control processing in this way, processing stands by until the skew feeding detection sensors 28*a* and 28*b* are turned on as illustrated in FIG. 8C (S27). Further, when the skew feeding detection sensors 28*a* and 28*b* are turned on (Y in S27), as illustrated in FIG. 8D, the side edge skew feeding amount Δe2 is subsequently calculated from the detection positions detected by the second side registration detection sensor 35*b* at the times t3 and t4.

That is, when the skew feeding detection sensors 28*a* and 28*b* detect (ON) the sheet S, the second side registration detection sensor 35*b* calculates the side edge skew feeding amount (S28). Subsequently, the control amount of each motor is computed based on the calculated side edge skew feeding amount and the skew feeding correction motors 23 and 24 are driven based on the computed control amount to perform the above preceding side deceleration control (S29). By this means, a pair of skew feeding correction rollers 21 and 22 rotate, so that skew feeding of the sheet S is completely corrected according to this second skew feeding correction.

Further, the above processings of S30 to S38 are subsequently performed. Furthermore, subsequently, by repeating S10 to S19 and S23 to S38 for sheets to be conveyed, it is possible to correct skew feeding of the sheets S and accurately correct the positions of the images on the drum 112 and sheets S continuously.

As described above, with the present embodiment, whether a sheet is a tab sheet is determined before skew feeding of the sheet is corrected, and, when the sheet is determined to be a tab sheet, the skew feeding correcting portion 1A is controlled based on the sheet side edge skew feeding amount. By this means, it is possible to accurately correct skew feeding without the influence of shape information accuracy from the user. Further, even when there are non-tab sheets and tab sheets in a mixed manner, it is possible to accurately correct skew feeding in single control, and increase the speed and improve productivity.

Furthermore, with the present embodiment, in the tab paper mode, correction of skew feeding is controlled according to the side edge skew feeding amount of the side registration detection sensors 35*a* and 35*b*, and, in the non-tab paper mode, correction of skew feeding is controlled according to the front end skew feeding amount of the activation sensors 27*a* and 27*b* and skew feeding detection sensors 28*a* and 28*b*. However, both in the tab paper mode and non-tab paper mode, the skew feeding correcting portion 1A may be controlled based on the side edge skew feeding amount of the side registration detection sensors 35*a* and 35*b*.

Incidentally, although a case has been described above where whether a sheet is a tab sheet is determined before skew feeding is corrected, the present invention is by no means limited to this. For example, information as to whether a sheet is a tab sheet or non-tab sheet may be input in advance.

Figure 9:
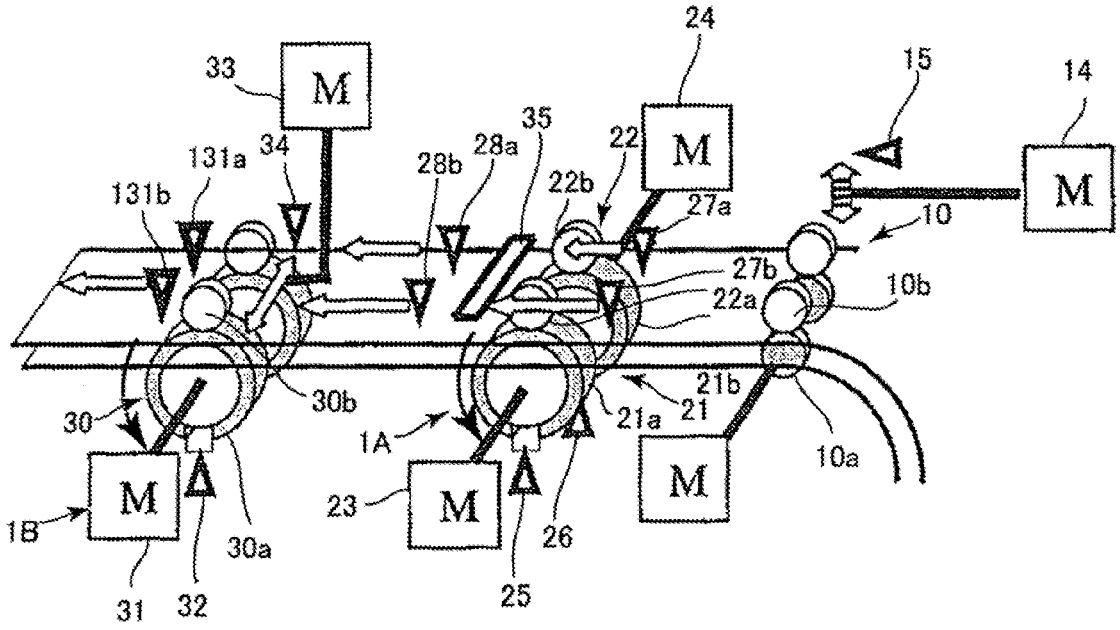
FIG. 9 is a view describing a configuration of a skew feeding/registration correcting portion provided in the sheet conveying apparatus of an image forming apparatus according to the second embodiment of the present invention.

FIG. 9 is a view describing a configuration of a skew feeding/registration correcting portion provided in a sheet conveying apparatus of an image forming apparatus according to the second embodiment of the present invention which receives in advance an input of information as to whether this sheet is a tab sheet or non-tab sheet. In addition, in FIG. 9, the same reference numerals as FIG. 2 indicate the same or corresponding portions.

With the present embodiment, as illustrated in FIG. 9, the side registration detection sensor 35 is provided in the downstream in the sheet conveying direction without providing the side registration detection sensor in the upstream of pairs of skew feeding correction rollers 21 and 22 in the sheet conveying direction. That is, with the present embodiment, only one side registration detection sensor 35 is used.

Figure 10:
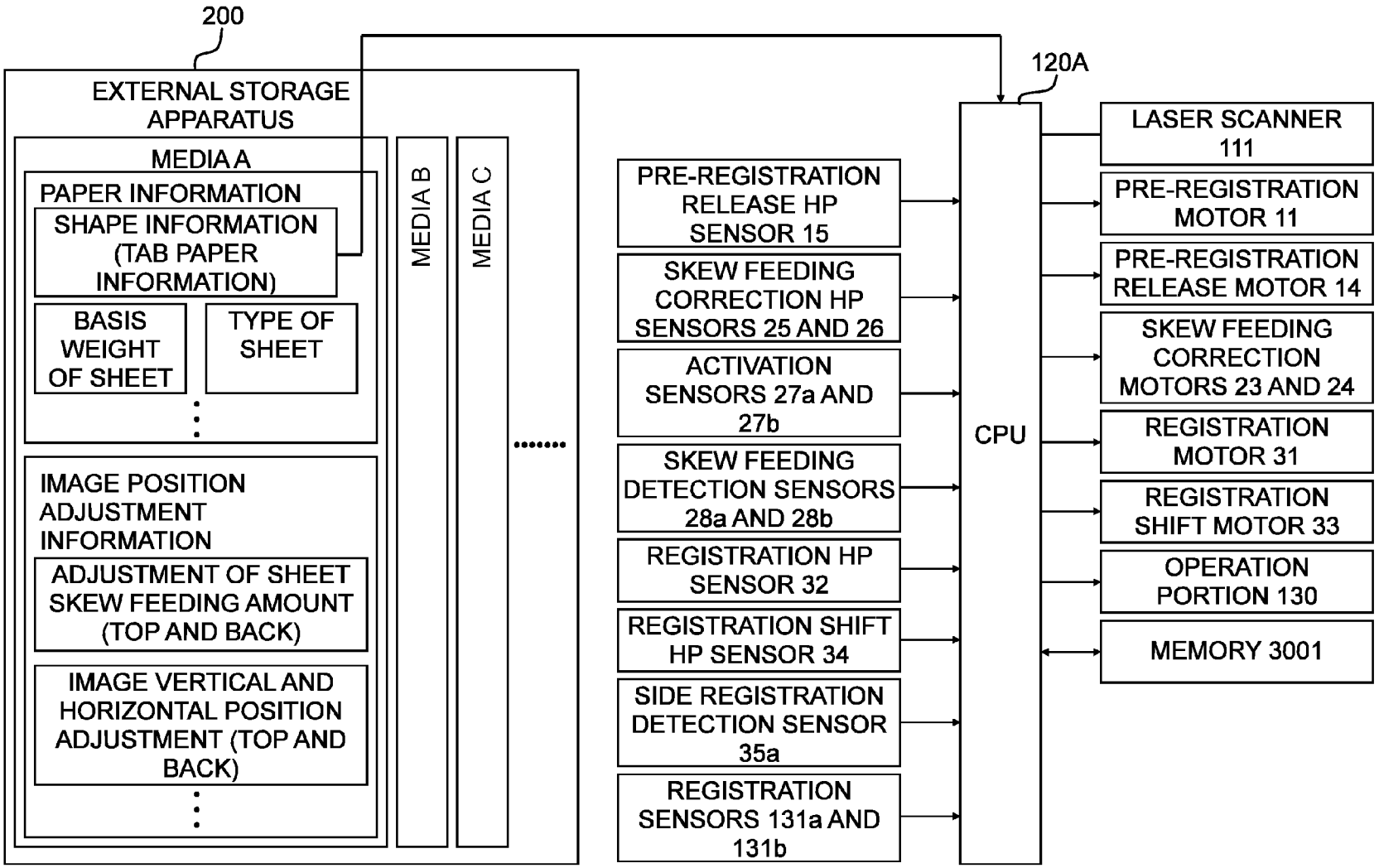
FIG. 10 is a control block diagram of the above image forming apparatus.

Further, with the present embodiment, an external storage apparatus 200 which registers various pieces of information as media information of each sheet as illustrated in FIG. 10 is connected to the CPU 120A. Hereinafter, this external storage apparatus 200 is an inputting portion which receives in advance an input of information as to whether a sheet is a tab sheet or non-tab sheet. Further, the CPU 120A performs a correction operation using information indicating "tab paper" or "non-tab paper" of information of media A, B, C . . . registered in the external storage apparatus 200.

Figure 11A:
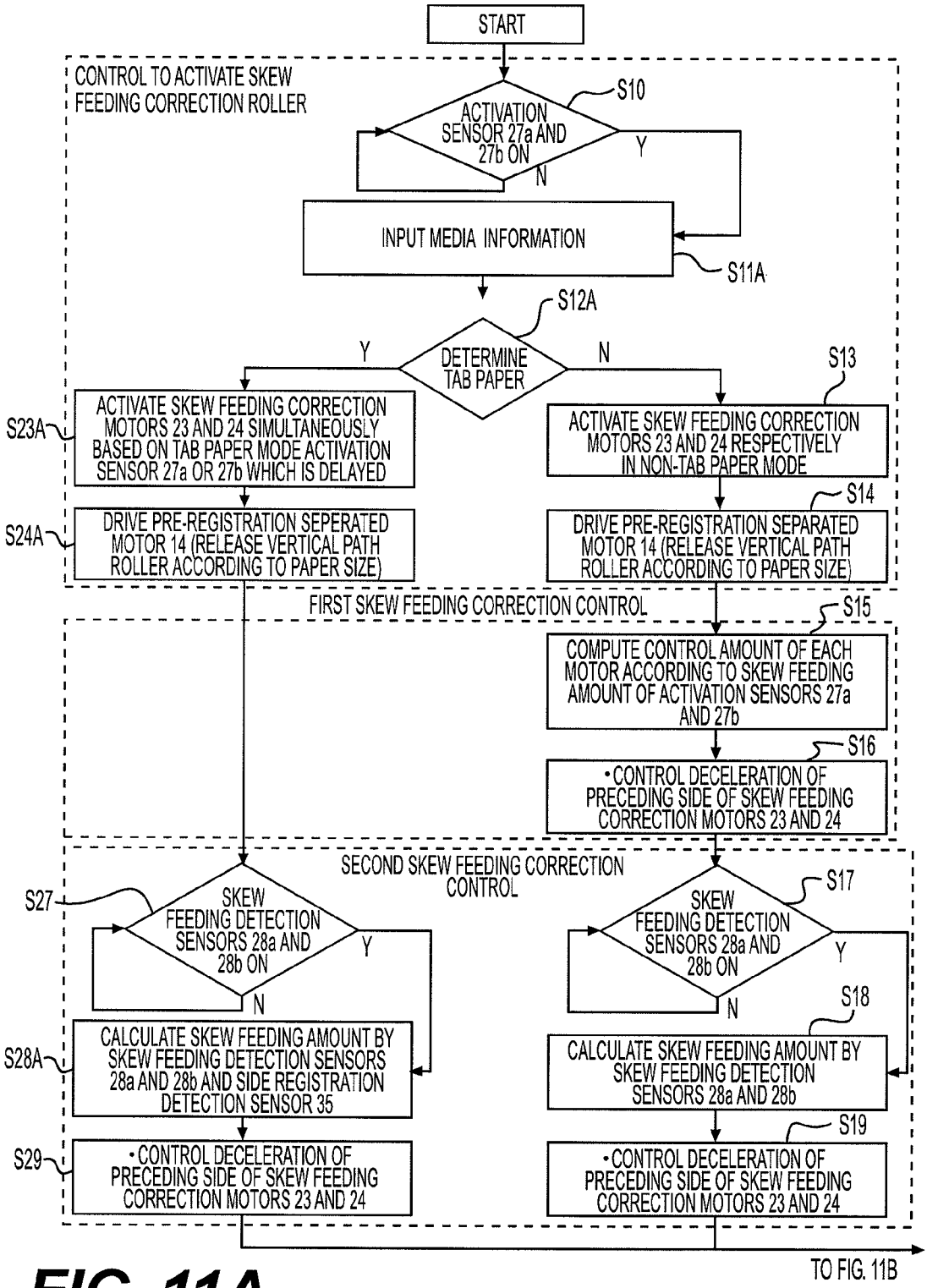
FIGS. 11A and 11B are a flowchart describing a skew feeding correcting and registration correcting control operation of the above skew feeding correcting portion; and Next, skew feeding correction and registration control operation by this CPU 120A (controller 120) will be described with reference to FIGS. 4A and 4B. In addition, with the present embodiment, tab sheets of non-rectangular sheets are among non-tab sheets of rectangular sheets in a mixed manner and conveyed.
Figure 11B:
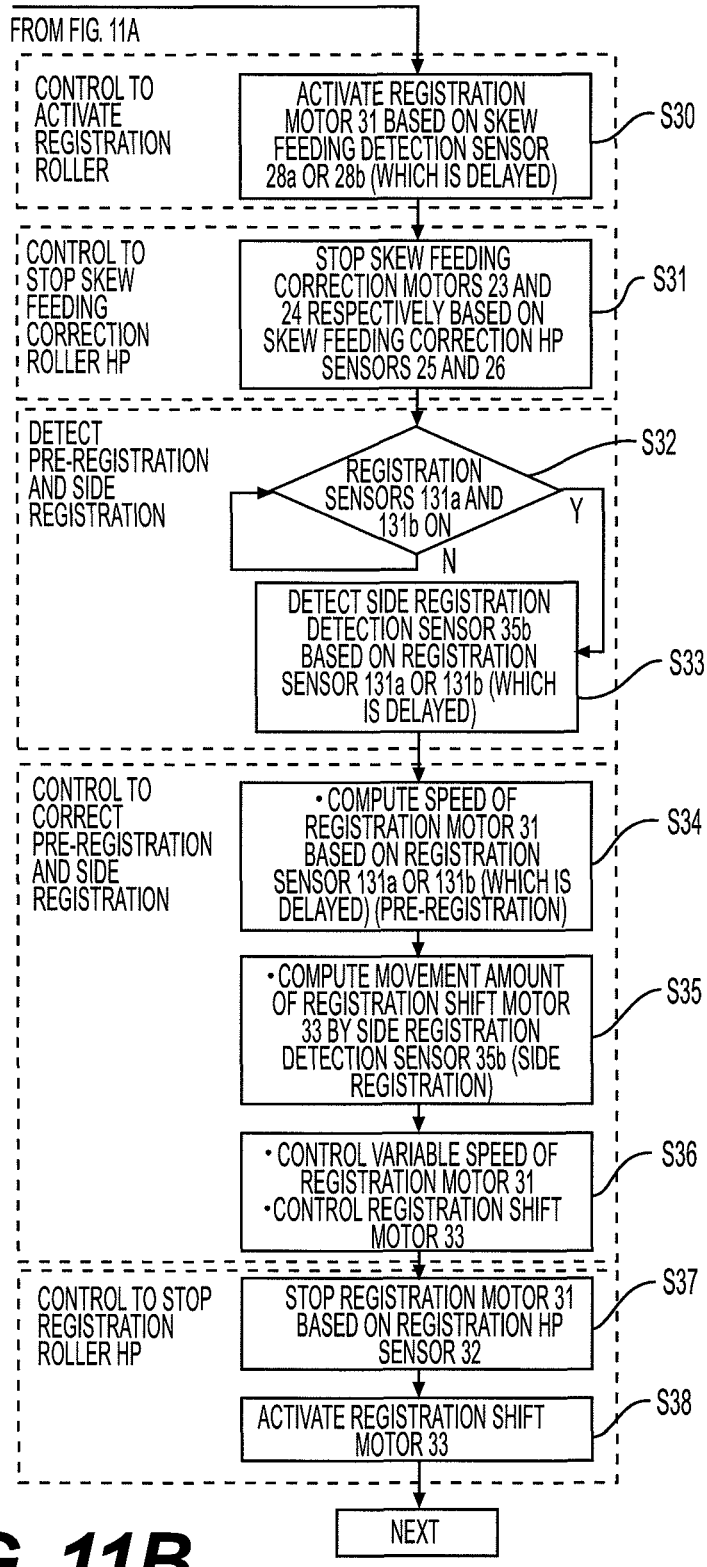

Next, a skew feeding correction and registration correction control operation by the CPU 120A (controller 120) according to the present embodiment will be described with reference to FIGS. 11A and 11B. When a copy or print signal is input from the operation portion 130, the sheet cassette 100 is first selected, and a sheet is fed from the selected sheet cassette 100, is passed through a pair of pre-registration rollers 10 by a pair of conveying rollers 105 and reaches the skew feeding/registration correcting portion 1.

Next, the activation sensors 27*a* and 27*b* detect (ON) the front end of the sheet S conveyed to the skew feeding/registration correcting portion 1 (Y in S10), media information of the sheet S registered in advance in the external storage apparatus 200 is read. Further, the read media information is input in a memory 3001 (S11A), and whether a sheet is a tab sheet or non-tab sheet is determined based on the input media information (S12A). Next, when the sheet is determined to be a non-tab sheet based on the input information (N in S12*a*), skew feeding correction processing according to S13 to S19 and S30 to S38 illustrated in FIG. 4 is performed in the non-tab paper mode.

When the tab paper mode is determined (Y in S12A), the skew feeding correction motors 23 and 24 are activated simultaneously based on the detection time of the activation sensor 27*a* or 27*b* which is delayed (S23A). By this means, pairs of skew feeding correction rollers 21 and 22 with the roller nip portions released rotate simultaneously to convey the sheet S. Further, the pre-registration release motor 14 is driven according to the sheet size (paper size) in this case (S24) to release nipping by the pre-registration roller 10 and release nipping by a pair of conveying rollers 105.

Figure 12A:
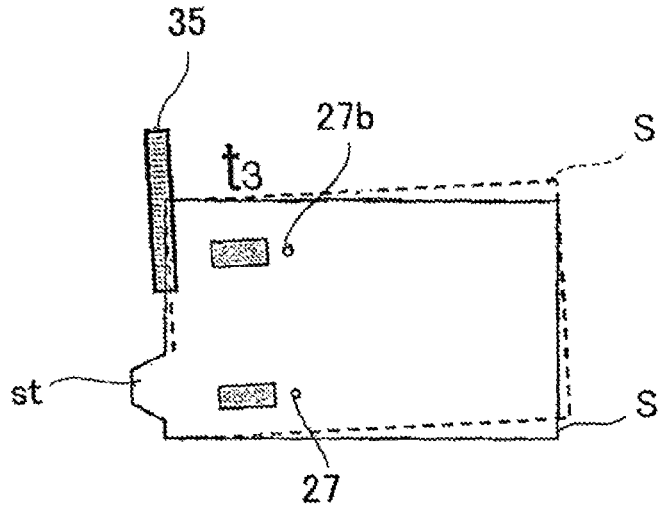
FIGS. 12A to 12C are views describing a skew feeding correcting and registration correcting control operation of the above skew feeding correcting portion.
Figure 12B:
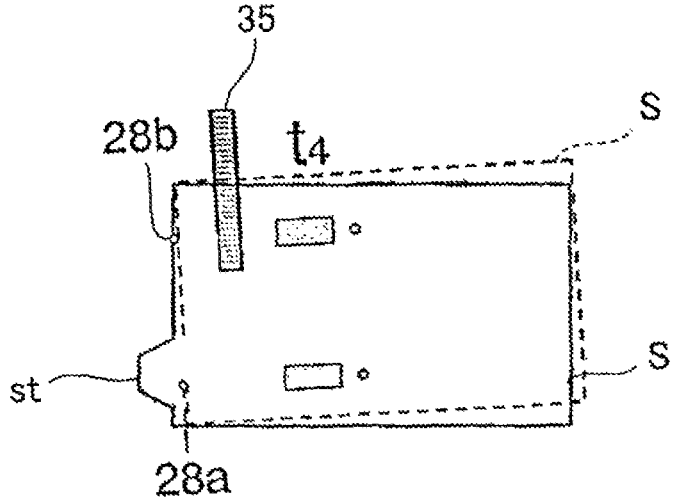

Next, the sheet side edge is detected by the side registration detection sensor 35 as illustrated in FIG. 12A. Subsequently, when the skew feeding detection sensors 28*a* and 28*b* detect (ON) the sheet front end as illustrated in FIG. 12B (Y in S27), the skew feeding detection sensors 28*a* and 28*b* calculate the front end skew feeding amount Δs2 according to the difference between timings when the skew feeding detection sensors 28*a* and 28*b* detect the sheet front end. Further, the side edge skew feeding amount Δe2 is calculated according to the difference between sheet side edge detection positions detected by the side registration detection sensor 35 at the times t3 and t4 (S28A).

Subsequently, the front end skew feeding amount Δs2 and side edge skew feeding amount Δe2 are compared. As illustrated in FIG. 12B, when the skew feeding detection sensors 28*a* and 28*b* detect the tab St, the front end skew feeding amount Δs2 and the side edge skew feeding amount Δe2 become different. In other words, when the tab St is at the position detected by the skew feeding detection sensors 28*a* and 28*b*, the front end skew feeding amount Δs2 and the side edge skew feeding amount Δe2 become different. Further, when the front end skew feeding amount Δs2 and side edge skew feeding amount Δe2 are different, the control amount of each motor is computed based on the calculated side edge skew feeding amount Δe2 and the skew feeding correction motors 23 and 24 are driven based on the computed control amount to perform the above preceding side deceleration control (S29).

Figure 12C:
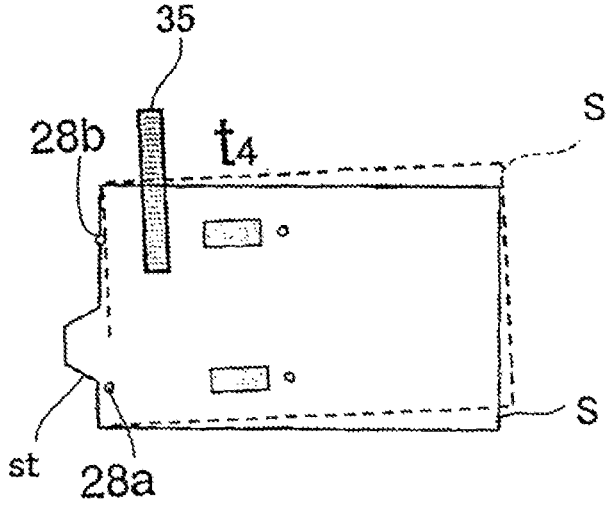

By contrast with this, as illustrated in FIG. 12C, when the tab St is not at the position detected by the skew feeding detection sensors 28*a* and 28*b*, the skew feeding detection sensors 28*a* and 28*b* detect the front end of the sheet S other than the tab, and therefore the front end skew feeding amount Δs2 and side edge skew feeding amount Δe2 are the same. Further, when the front end skew feeding amount Δs2 and side edge skew feeding amount Δe2 are the same as described above, the control amount of each motor is computed based on the calculated front end skew feeding amount Δs2 and the skew feeding correction motors 23 and 24 are driven based on the computed control amount to perform the above preceding side deceleration control (S29).

By this means, pairs of skew feeding correction rollers 21 and 22 rotate, so that skew feeding of the sheet S is completely corrected. Further, the above processings of S30 to S38 are subsequently performed. Furthermore, by repeating S10 to S19 and S23A to S38 for sheets to be conveyed, it is possible to correct skew feeding of the sheets S and accurately correct the positions of the images on the drum 112 and sheets S continuously.

As described above, when the tab St of the sheet S is at the position detected by the skew feeding detection sensors 28*a* and 28*b*, skew feeding correction control is performed according to the side edge skew feeding amount calculated by the side registration detection sensor 35. Further, when the tab St of the sheet S is not at the position detected by the skew feeding detection sensors 28*a* and 28*b*, skew feeding correction control is performed according to the sheet front end skew feeding amount calculated by the skew feeding detection sensors 28*a* and 28*b*. By this means, it is possible to accurately correct skew feeding irrespectively of the position of the tab St.

In addition, skew feeding correction control is not limited to the configuration described above, and, when a sheet is a rectangular sheet, a skew feeding correcting portion may be controlled based on one of the skew feeding amount of the sheet side edge and the skew feeding amount of the sheet front end. Further, in the tab paper mode, skew feeding correction control may be performed according to the side edge skew feeding amounts all of which are calculated by the side registration detection sensor 35. Furthermore, upon second skew feeding correction (S27 to S29), skew feeding correction control may be performed according to the side edge skew feeding amount calculated by the side registration detection sensor 35 both in the tab paper mode and non-tab paper mode.

Still further, although a case has been described above where the present invention is used in the sheet conveying apparatus 1004 provided in the printer 1000 which is an example of the image forming apparatus, the present invention is by no means limited to this. The sheet conveying apparatus according to the present invention may be used as a sheet conveying apparatus which conveys sheets (document) to an image reading portion in the scanner 2000 which is an example of an image reading apparatus having the image reading portion.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2010-171704, filed Jul. 30, 2010, which is hereby incorporated by reference herein in its entirety.

What is claimed is:

1. A sheet conveying apparatus comprising:

a front end detecting portion which detects a front end of a sheet in a sheet conveying direction;

a side edge position detecting portion which detects a side edge parallel to the sheet conveying direction of the sheet;

a skew feeding correcting portion which corrects skew feeding of the sheet to be conveyed;

an inputting portion which inputs information that a sheet is a rectangular sheet or a tab sheet including a tab at a front end; and a controlling portion which controls the skew feeding correcting portion to correct skew feeding of the sheet based on a detection of front end detecting portion in a case that information inputted from the inputting portion is the rectangular sheet and controls the skew feeding correcting portion to correct skew feeding of the sheet based on a detection of the side edge position detecting portion in a case that information inputted from the inputting portion is the tab sheet including a tab at the front end.

2. The sheet conveying apparatus according to claim 1, wherein the controlling portion calculates a skew feeding amount of the front end of the sheet based on detection of the front end detecting portion and calculates a skew feeding amount of the side edge of the sheet based on detection of the side edge position detecting portion, and controlling portion controls the skew feeding correcting portion so as to correct skew feeding of the sheet based on the skew feeding amount calculated by the controlling portion.

3. The sheet conveying apparatus according to claim 1, wherein the side edge position detecting portion is a line sensor arranged in a width direction.

4. The sheet conveying apparatus according to claim 1, wherein the skew feeding correcting portion includes a pair of driving rollers disposed at a predetermined interval in the width direction orthogonal to the sheet conveying direction, and skew feeding correction motors connected with the driving rollers such that the driving rollers are driven independently.

5. An image forming apparatus which includes an image forming portion which forms an image on a sheet conveyed by a sheet conveying apparatus, the image forming apparatus comprising:

a front end detecting portion which detects a front end of a sheet in a sheet conveying direction;

a side edge position detecting portion which detects a side edge parallel to the sheet conveying direction of the sheet;

a skew feeding correcting portion which corrects skew feeding of the sheet to be conveyed;

an inputting portion which inputs information that a sheet is a rectangular sheet or a tab sheet including a tab at a front end; and a controlling portion which controls the skew feeding correcting portion to correct skew feeding of the sheet based on a detection of the front end detecting portion in a case that information inputted from the inputting portion is the rectangular sheet and controls the skew feeding correcting portion to correct skew feeding of the sheet based on a detection of the side edge position detecting portion in a case that information inputted from the inputting portion is the tab sheet including the tab at the front end.

6. The image forming apparatus according to claim 5, wherein the controlling portion calculates skew feeding amount of the front end of the sheet based on detection of the front end detecting portion and calculates a skew feeding amount of a side edge of the sheet based on detection of the side edge position detecting portion, and controlling portion controls the skew feeding correcting portion so as to correct skew feeding of the sheet based on the skew feeding amount calculated by the controlling portion.

7. The image forming apparatus according to claim 5, wherein the side edge position detecting portion is a line sensor arranged in a width direction.

8. The sheet conveying apparatus according to claim 5, wherein the skew feeding correcting portion includes a pair of driving rollers disposed at a predetermined interval in the width direction orthogonal to the sheet conveying direction, and skew feeding correction motors connected with the driving rollers such that the driving rollers are driven independently.

* * * * *